US007341508B2

(12) United States Patent
Rigo

(10) Patent No.: US 7,341,508 B2
(45) Date of Patent: Mar. 11, 2008

(54) CONFIGURABLE COIN DISPENSER

(75) Inventor: Fabrizio Rigo, Bologna (IT)

(73) Assignee: Hopper S.r.L., Bologna (IT)

( * ) Notice: Subject to any disclaimer, the term of this patent is extended or adjusted under 35 U.S.C. 154(b) by 0 days.

(21) Appl. No.: 11/151,706

(22) Filed: Jun. 13, 2005

(65) Prior Publication Data

US 2005/0277379 A1 Dec. 15, 2005

(30) Foreign Application Priority Data

Jun. 14, 2004 (IT) ..... BO2004A000373

(51) Int. Cl.
*G07D 1/00* (2006.01)

(52) U.S. Cl. ..... 453/18; 193/DIG. 1

(58) Field of Classification Search ..... 453/18; 194/344, 350, 351; 193/4, DIG. 1
See application file for complete search history.

(56) References Cited

U.S. PATENT DOCUMENTS 4,787,873 A * 11/1988 Borrmann et al. ..... 446/8
5,797,476 A 8/1998 Jones et al.
6,569,006 B1 5/2003 Kurosawa et al.
6,749,052 B2 * 6/2004 Carmichael ..... 194/201
6,983,836 B2 * 1/2006 Adams et al. ..... 194/302
7,014,554 B1 * 3/2006 Fletcher et al. ..... 453/20
2003/0148729 A1 8/2003 Abe et al.
2003/0201146 A1 10/2003 Abe et al.

FOREIGN PATENT DOCUMENTS

DE 8812583 4/1989

* cited by examiner

*Primary Examiner*—Patrick Mackey
*Assistant Examiner*—Mark J. Beauchaine
(74) *Attorney, Agent, or Firm*—William J. Sapone; Coleman Sudol Sapone P.C.

(57) ABSTRACT

A configurable coin dispenser includes a box-like structure, which has a storage container, situated thereinside for storing coins of a certain value, and which has a coin outlet passage leading to a chamber, open toward a front wall, so as to dispense the coins. The dispenser includes a first additional coin outlet slot, situated on a first lateral wall of the box-like structure and facing the chamber. Coin conveying means can be situated removably inside the chamber to join the outlet passage to the first additional slot, so as to guide the coins leaving the outlet passage to the first additional slot, in order to dispense the coins from the first lateral wall. The dispenser includes also a coin inlet slot, made on another lateral wall of the box-like structure, an additional coin guiding channel, extending from the coin inlet slot and leading to the chamber, and receiving coins of a second value, coming from a second coin dispenser, and conveying the coins of the second value to the chamber, so as to dispense the coins of the second value from the front wall.

23 Claims, 7 Drawing Sheets

FIG.5
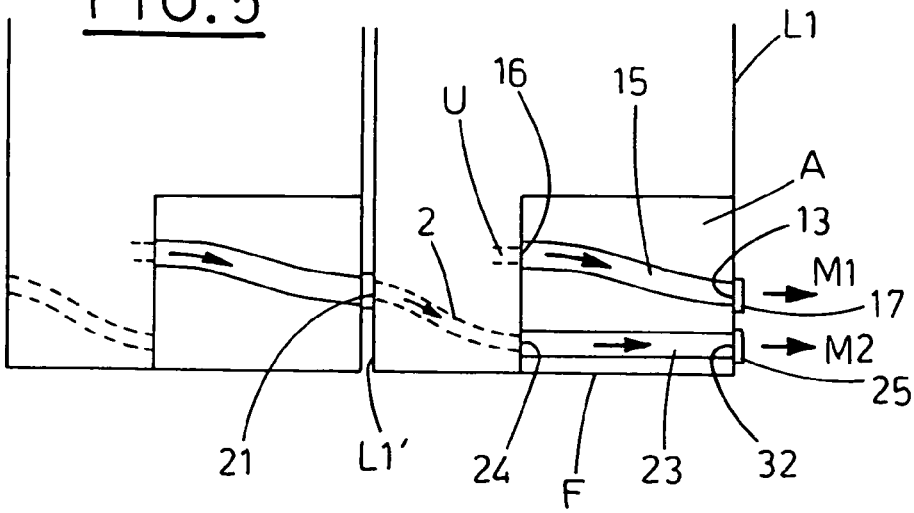
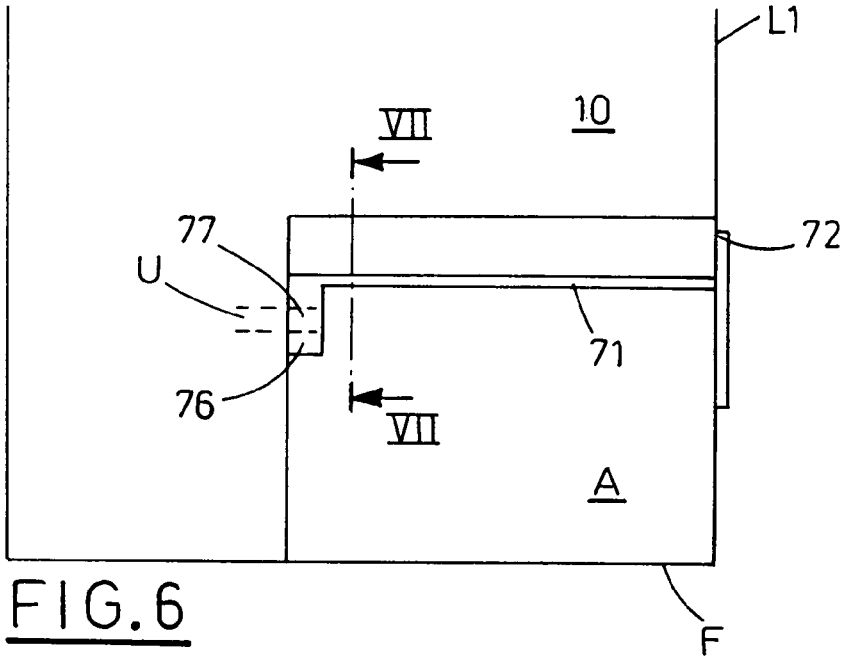
FIG.6
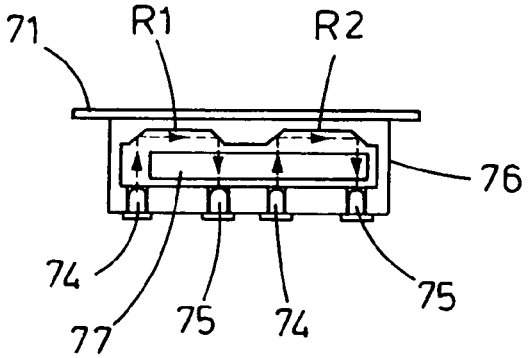
FIG.7

CONFIGURABLE COIN DISPENSER

BACKGROUND OF THE INVENTION

The present invention relates to automatic devices for delivering and distributing coins, and more particularly relates to a configurable coin dispenser.

BRIEF DESCRIPTION OF THE PRIOR ART

Known devices for delivering coins include a magazine for accumulating coins of the same value and a dispenser situated therebelow, inside which the coins to be delivered and distributed are conveyed by gravity.

The coin magazine is situated inside the automatic machines for payment or coin distribution (coin change), while the dispenser is placed, below the magazine, inside suitable recesses made on the facing of the machines, so as to face outwards with a relative wall, for example the front wall.

The coin dispenser includes a box-like structure, whose upper wall is partially open, so as to receive the coins from the magazine, and which includes, situated thereinside, a collecting container for accumulating the coins and having a coin discharge opening situated on its bottom.

The dispenser includes also means for withdrawing coins from the bottom of the container and for conveying them toward an outlet slot, so as to dispense and distribute them in a position corresponding to the front wall.

For this purpose, the front wall of the dispenser has a chamber, open outwards, on which the coin outlet slot opens, and which has a conveying chute, situated below the slot, for dispensing and distributing coins.

Therefore, at present, the coins are dispensed only at a position corresponding to the front wall of the dispenser.

This is limiting for the structure design and the arrangement of the dispenser inside the automatic payment machines or coin distributing machines.

Moreover, in order to enable an automatic machine to dispense coins of different value, it is necessary to make various recesses, inside which corresponding dispensers will be situated for dispensing different value coins.

Consequently, the front wall of the machines have two separate sections, spaced apart, for dispensing coins: this is doubtlessly a drawback for the user.

SUMMARY OF THE INVENTION

Therefore, the object of the present invention is to propose a new coin dispenser, configurable, which can avoid the disadvantages of the coin dispensers used so far.

In particular, the main object of the present invention is to propose a new coin dispenser, which can be configured in a simple and immediate way, so as to change the coin dispensing wall, and thus to allow the change the coin dispensing section of the relative automatic machine, inside which it is installed, without being withdrawn and replaced in a new, different orientation.

Another object of the present invention is to propose new coin dispensers, which can be configured so as to be connected one to another according to a particular reciprocal arrangement, which allows them to be situated in the same recess inside an automatic machine for payment or coin distribution, in order to dispense coins of different value from the same dispensing section, or from two separate dispensing sections, situated close to each other.

A further object of the present invention is to propose a new dispenser, which can change its configuration, in order to change the positioning of the coins dispensing section in an extremely rapid and functional way.

The above mentioned objects are wholly obtained, in accordance with the contents of the claims, by means of a configurable coin dispenser including:

a box-like structure and a storage container situated inside said box-like structure for storing coins;

a chamber define in said box-like structure with an opening at a front wall of the box-like structure:

a coin outlet passage leading to the chamber to dispense the coins;

a first additional coin outlet slot, situated on a first lateral wall of said box-like structure and facing said chamber;

coin conveying means, removably situated inside said chamber to connect said outlet passage with said first additional slot, so as to guide coins leaving said outlet passage to said first additional slot, and dispense the coins from said first lateral wall.

According to a second embodiment, the configurable coin dispenser includes a coin inlet slot, situated on a lateral wall of said box-like structure, and additional inner coin guiding channel, which extends from the coin inlet slot and leads to said chamber, and which receives coins of a second value coming from another coin dispenser and guide them to said chamber, so that also the coins of second value are dispensed at the front wall.

Also an arrangement is claimed, of configurable coin dispensers, including:

a first configurable dispenser for the first coins of a first value, having an outlet passage for said first coins of the first value, which leads to a chamber with an opening on a relative front wall in order to dispense the coins and which includes a coin inlet slot, made on the first lateral wall, and an additional coin guiding channel, which extends from the inlet slot to the chamber;

a second configurable dispenser for second coins of a second value, having an outlet passage for said second coins of the second value, with said second dispenser having also a first additional slot, made on a lateral wall and coin conveying means removably placed inside the chamber, so as to connect the outlet passage with the first additional slot, in order to dispense the coins from the lateral wall, and in that said second dispenser is connected to the first dispenser by the lateral wall, which is beside the first lateral wall of the first dispenser, and by the first additional slot, facing and joined to the inlet slot of the additional inner guiding channel of the first dispenser, so that the coins of the second dispenser are conveyed to the chamber of said first dispenser and dispensed from the front wall of the latter.

BRIEF DESCRIPTION OF THE DRAWINGS

The characteristic features of the invention will become obvious from the following description, given as an example and not limiting, with reference to the enclosed figures, in which:

FIG. 5 is a partially schematic view of particularly significant elements of the proposed dispenser in a operation configuration shown in FIG. 4*c;*

FIG. 6 is a partially schematic view of other characteristic elements of the dispenser proposed by the present invention;

FIG. 7 is a section view taken along VII-VII of FIG. 6;

DISCLOSURE OF THE PREFERRED EMBODIMENTS

With regards the enclosed Figures, the reference letter (E) generally indicates the configurable coin dispenser, proposed by the present invention.

Figure 1:
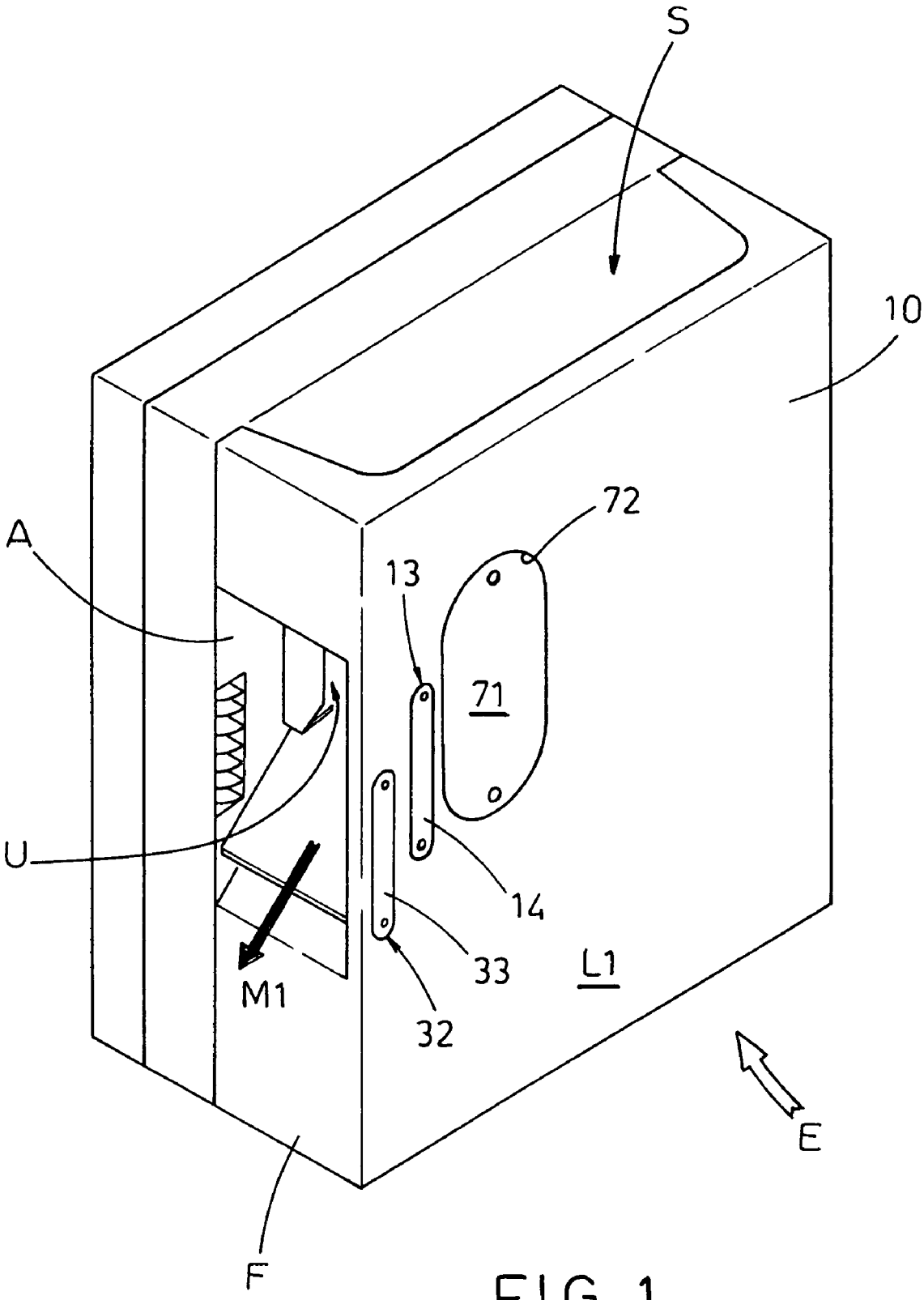
FIG. 1 is a schematic, perspective view of the configurable coin dispenser proposed by the present invention, in a usual dispensing configuration of prior art dispensers.
Figure 3:
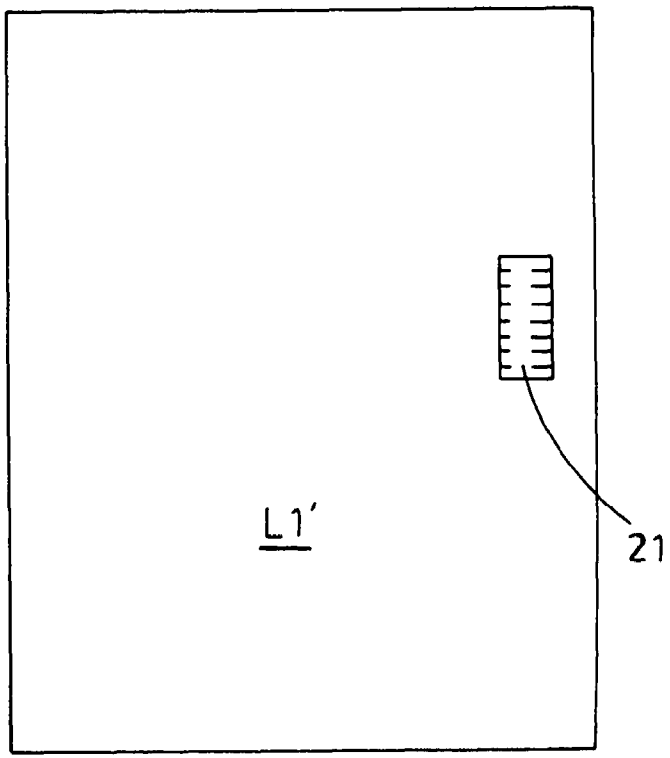
FIG. 3 is a top view of a lateral wall of the proposed dispenser.

The dispenser (E), as shown in FIG. 1, includes a box-like structure (10), which has a storage container (S), situated thereinside for storing coins (M1) of the same value coming from a magazine (not shown) and conveyed due to the gravity into the storage container (S) through the upper wall of the dispenser (E), purposely open to some extent.

The dispenser (E) has a coin outlet passage (U), which opens into a chamber (A), open toward a relative front wall (F).

The dispenser (E) has also means (not shown, since they are known and do not need to be protected by the present invention) for withdrawing coins from the bottom of the storage container (S) and for conveying them to the outlet passage (U), in order to dispense the coins (M1).

The dispenser (E), when in the operation configuration as shown in FIG. 1, dispenses the coins (M1) contained therein from the front wall (F), as it occurs usually in the prior art dispensers.

The distinctive feature of the dispenser (E) proposed by the present invention lies in the fact that it can be configured, so as to allow the dispensing of coins contained therein also from a first lateral wall (L1).

Figure 2:
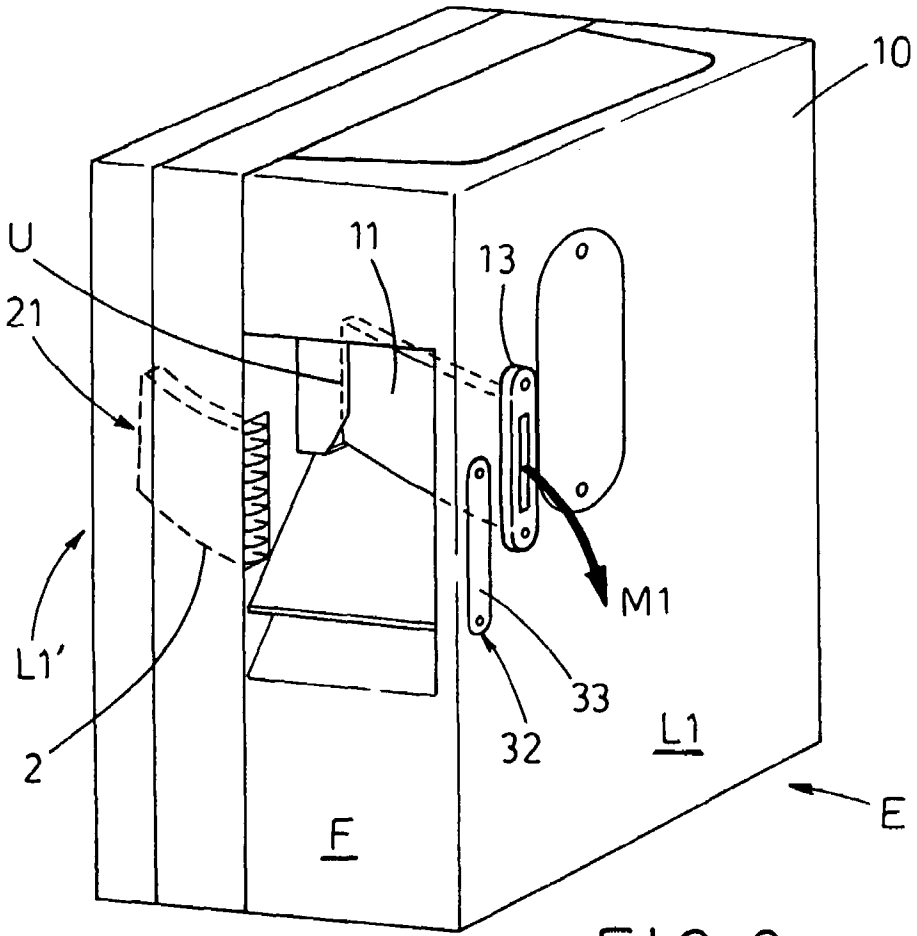
FIG. 2 is a schematic, perspective view of the coin dispenser proposed by the invention, in a first characteristic coin dispensing configuration.

Actually, as it is shown in FIG. 2, the dispenser (E) has a first additional slot (13) of coin outlet, which is made on the first lateral wall (L1), and which can be freed by the removal of a closing door (14), and means (11) for conveying coins, which can be removably placed inside the chamber (A), in order to connect the outlet passage (U) with the first additional slot (13).

Consequently, after having been set in the described configuration, the conveying means (11) convey the coins (M1), leaving the outlet passage (U), to the first additional slot (13), so as to dispense and distribute them from the first lateral wall (L1), instead of the front wall (F).

The conveying means (11) can include for example a first elongated element (15), which has, at its first end, a first coin inlet opening (16), and at its second end, a second coin outlet opening (17), and which forms, thereinside, a coin guiding channel.

The first elongated element (15) can be situated removably inside the chamber (A), by e.g. its introduction through the first additional slot (13), when the latter has been freed from the closing door (14), so that the first inlet opening (16) joins with the outlet passage (U) and so that the second outlet opening (17) is situated in a position corresponding to the first additional slot (13) made in the first lateral wall (L1) of the dispenser (E) (See FIG. 5).

Another distinctive feature of the dispenser (E), proposed by the present invention, lies in the fact that it includes a coin inlet slot (21), situated on another wall, opposite to the first lateral wall (L1), and an additional coin guiding channel (2), which extends from the inlet slot (21) and opens into the chamber (A).

Figure 4A:
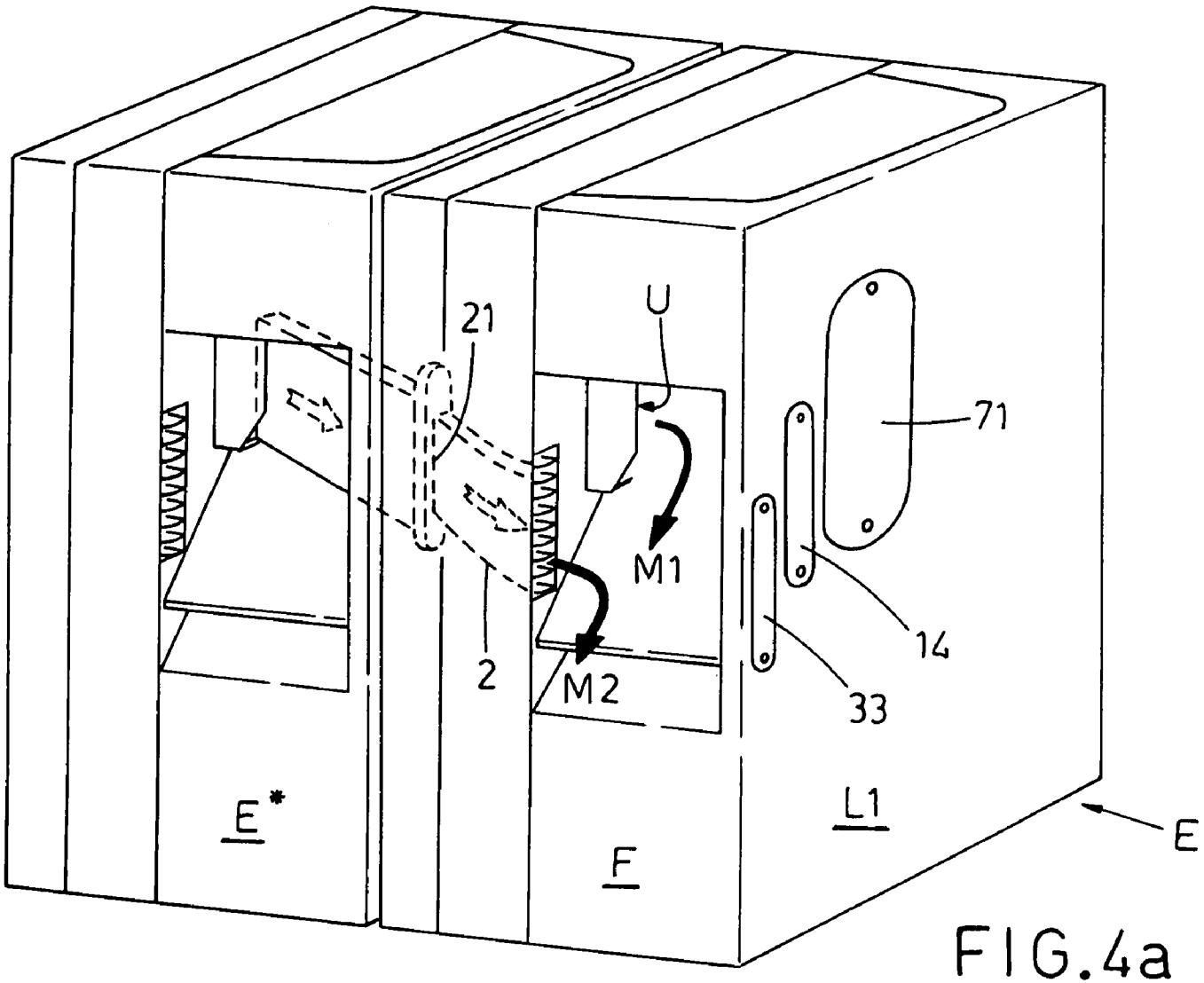
FIGS. 4*a*, 4*b*, 4*c* are respective schematic, perspective views of the configurable coin dispenser, proposed by the present invention, in corresponding further possible characteristic coin dispensing configurations.

This allows the dispenser (E), as shown for example in the configuration of FIG. 4*a*, in which it does not have the coin conveying means (11), to receive, through the inlet slot (21), coins of a different value (M2), coming from a second dispenser (E*), and to convey the coins (M2), by the additional inner channel (2), to the chamber (A), so as to dispense the coins (M2) from the front wall (F).

Thus, the dispenser (E) is capable of dispensing coins of two different values, respectively (M1) and (M2), from its front wall (F), and consequently from the same dispensing point.

Figure 4B:
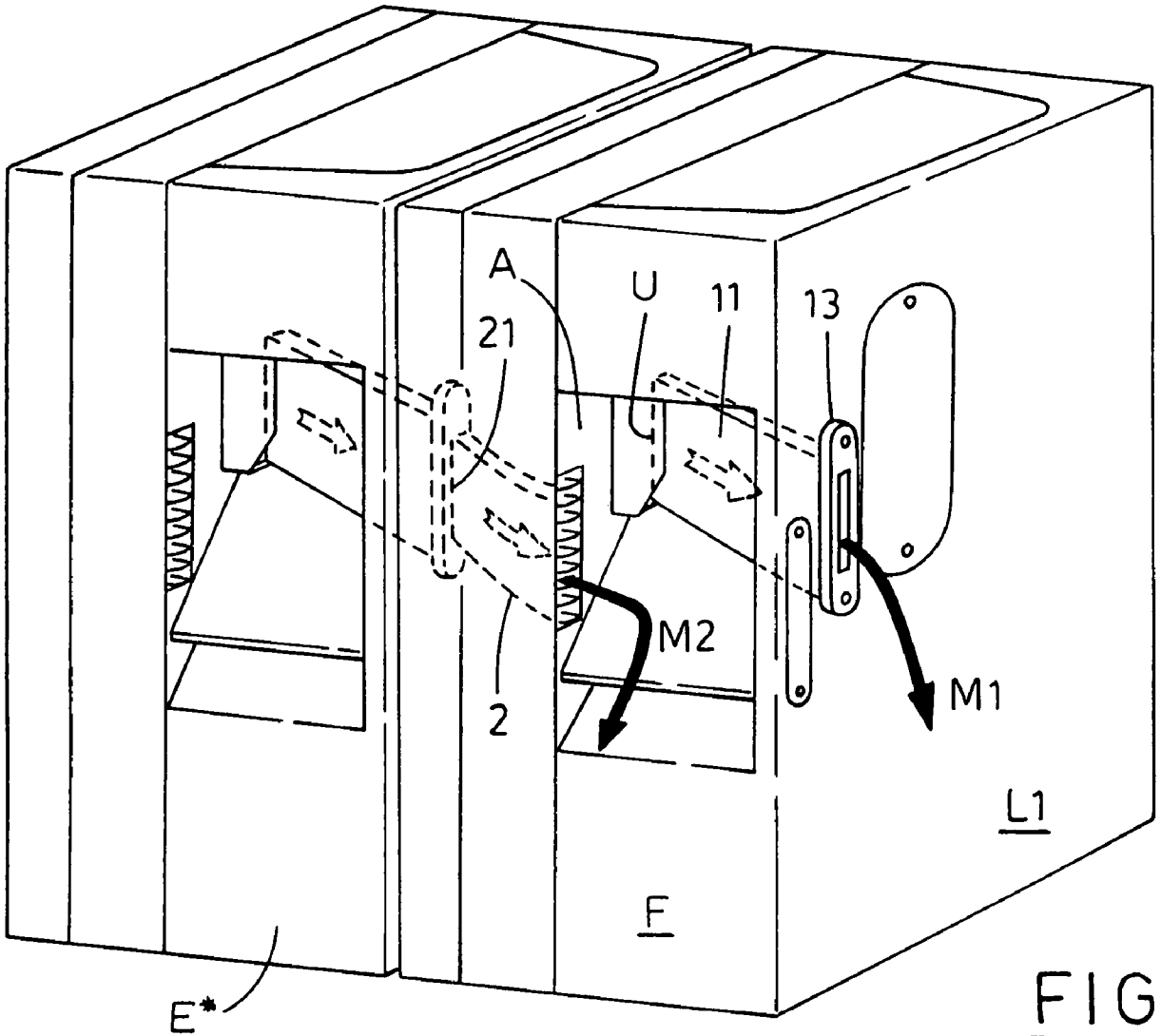
Figure 4C:
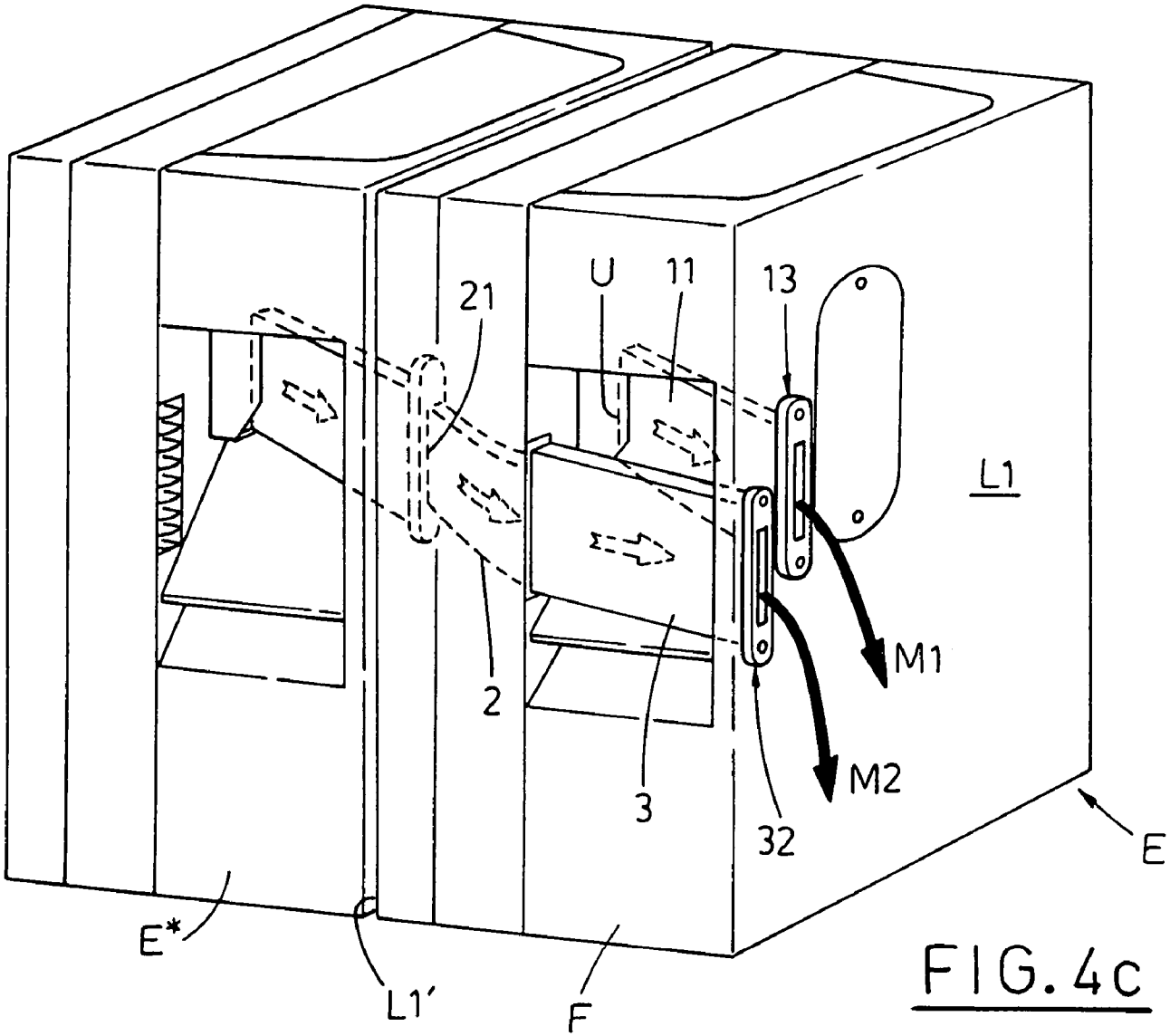

Further, according to other possible configurations, the dispenser (E) can:

a) dispense coins of the first value (M1), contained therein, from its first lateral wall (L1) and dispense the coins of the second value (M2), coming from the second dispenser (E*), from its front wall (F), thus dispensing the coins of two different values from dispensing points, situated one close to the other, as shown in FIG. 4*b;* b) dispense the coins of the first value, contained therein, from its first lateral wall (L1) and dispense also the coins of the second value (M2), coming from the second dispenser (E*), from the same first lateral wall (L1), thus dispensing the coins of two different values from the same dispensing point, as shown in FIG. 4*c*.

The configuration described in point a) and shown in FIG. 4*b*, is obtained by positioning the coin conveying means (11) inside the chamber (A), in the way described before.

In order to obtain the configuration described in point b) and shown in FIG. 4*c*, the dispenser (E) has a second additional coin outlet slot (32), which is made on the same first lateral wall (L1), and which can be freed due to the removal of a closing door (33), and coin guiding means (3), which can be positioned removably inside the chamber (A), so as to join the outlet of the additional inner channel (2) to the second additional slot (32).

Consequently, the dispenser (E) can guide and convey the coins (M2) coming from the second dispenser (E*), to the second additional slot (32), so as to dispense them from the same first lateral wall (L1), from which it dispenses the coins (M1) contained therein.

The above mentioned guiding means (3), as shown for example in FIG. 5, can include a second elongated element (23), which has, at its first end, a first coin inlet opening (24), and at the other end, a second coin outlet opening (25), and which forms, thereinside, a coin guiding channel, extending from the first opening (24) to the second opening (25).

The second elongated element (23) can be situated removably inside the chamber (A), by e.g. its introduction through the second additional slot (32), when the latter has been freed from the relative closing door (33), so that the first inlet opening (24) joins with the outlet of the additional inner channel (2) and so that the second outlet opening (25) is situated in a position corresponding to the second additional slot (32) made in the first lateral wall (L1) of the dispenser (E).

Consequently, as it results from what above, after having been configured according to the two respective operation configurations shown in FIG. 1 and in FIG. 2, the dispenser (E) can dispense the coins (M1) of a first value contained therein, from its front wall (F), or from its first lateral wall (L1).

This is undoubtedly an advantage, because it is possible to change the coin dispensing point of the automatic machine in a simple and immediate way, without removing the dispenser from its recess, re-introducing and re-positioning it according to a different orientation and arrangement.

After having been configured in the three operation configurations shown in FIGS. 4*a*, 4*b* and 4*c*, the same dispenser (E) can:

dispense the coins (M1) of the first value, contained therein, and dispense the coins (M2) of the second value, coming from the second dispenser (E*), from its front wall (F), thus from the same dispensing point;

dispense the coins (M1) of the first value, contained therein, from its first lateral wall (L1) and dispense the coins (M2) of the second value, coming from the second dispenser (E*), from its front wall (F), from two dispensing points, situated close to each other;

dispense the coins (M1), contained therein, and dispense the coins (M2), coming from the second dispenser (E*), from its first lateral wall (L1), thus from the same dispensing point.

The dispenser (E) has also means (7) for detecting the passage of coins through the outlet passage (U), which are connected to electronic control means (not shown) and which count the dispensed coins and their amount.

The sensor means (7) and the electronic control means, as shown in FIG. 6, are carried by a support element (71), which can be placed removably inside the box-like structure (10) of the dispenser (E), through a window (72) made in the first lateral wall (L1) of the dispenser (E)

The sensor means (7) include diodes (74), emitting light radiation (optical rays), and diodes (75) receiving light radiation (optical rays), which are to be put beside a first edge of the outlet passage (U), and means (R1, R2), reflecting the light radiation, which are to be situated close to a second edge of the outlet passage (U), opposite to the first edge and in front of the emitter diodes (74) and the receiver diodes (75).

The reflecting means (R1, R2) receive the optical rays emitted by the emitter diodes (74), which pass through the outlet passage (U), and convey them, by reflecting, to the receiver diodes (75), so that the reflected optical rays pass again through the outlet passage (U).

In particular, as shown in FIG. 7, the emitter diodes (74) and the receiver diodes (75), as well as the reflecting means (R1, R2), are introduced into the opposite edges of a projection section (76), formed on the support element (71) and defining a coin passage slot (77), which is to be put beside and joined to the outlet passage (U), when the support element (71) is introduced into the box-like structure (10) of the dispenser (E) through the window (72).

The transfer of a coin through the outlet passage (U), and consequently through the slot (77) of the projecting section (76), causes the interruption of at least one optical ray passing through the same slot (77): this interruption is detected by the control means connected to the diodes, which detect the passage of the coin and its subsequent dispensing.

Advantageously, as shown in FIG. 7, more emitter diodes (74) and corresponding receiver diodes (75) can be used, so as to cover as much as possible of the area of the slot (77), through which the coins to be delivered pass.

The reflecting means (R1, R2) can include e.g. prisms introduced into recesses made in the edge of the slot (77) opposite to the edge, in which the emitter and receiver diodes are placed.

A relative reflecting prism can be used for each pair of emitter and receiver diodes.

The protection of the present invention covers also an arrangement of coin dispensers, which uses coin dispensers configurable as described before.

Figure 8:
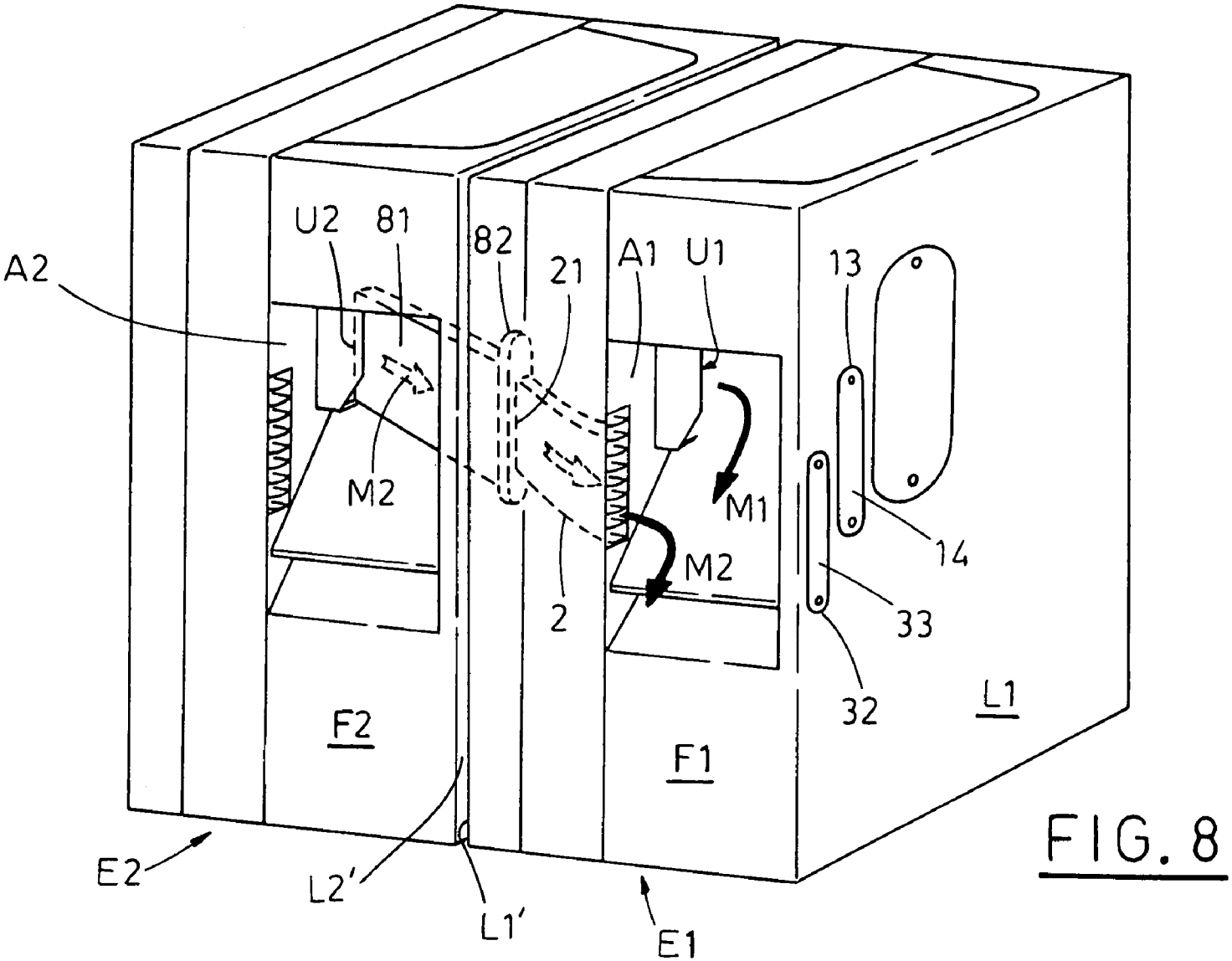
FIG. 8 is a schematic, perspective view of an example arrangement of configurable coin dispensers according to the invention.

This arrangement of configurable coin dispensers includes, as shown in FIG. 8:

at least one first configurable dispenser (E1) of coins (M1) of a first corresponding value, including an outlet passage (U1) for the coins (M1), which opens into a chamber (A1), having an opening in a position corresponding to a front wall (F1), so as to dispense the coins (M1), the first dispenser (E1) having also a coin inlet slot (21), made on a first lateral wall (L1'), and an additional inner channel (2) for guiding coins, extending from the inlet slot (21) and opening into the chamber (A1), at least one second configurable dispenser (E2) of coins (M2) of a second corresponding value, including an outlet passage (U2) for the coins (M2), which opens into a chamber (A2), with an opening in a position corresponding to a front wall (F2), so as to dispense the coins (M2), the second dispenser (E2) having also a first additional slot (82) made on a lateral wall (L2') and coin conveying means (81), which can be placed removably inside the chamber (A2), so as to join the outlet passage (U2) to the first additional slot (82), in order to dispense the coins (M2) from the lateral wall (L2'), where the second dispenser (E2) is connected to the first dispenser (E1) by the lateral wall (L2'), which is beside the first lateral wall (L1') of the first dispenser (E1), and by the first additional slot (82), facing and joined to the inlet slot (21) of the additional inner guiding channel (2) of the first dispenser (E1).

This arrangement allows to convey the coins (M2) of the second dispenser (E2) to the chamber (A1) of the first dispenser (E1), so that the coins (M2) are dispensed from the front wall (F1) of the first dispenser (E1), together with the coins (M1) contained in the first dispenser (E1).

The first dispenser (E1) can be advantageously configured in a way as described previously (with reference to FIG. 4*b*), so as to allow the dispensing of the coins (M1), contained therein, from the second lateral wall (L1) and to allow dispensing of the coins (M2), coming from the second dispenser (E2), from the front wall (F1).

For this purpose, the first dispenser (E1) includes a first additional coin outlet slot (13) made on the second lateral wall and coin conveying means (11), which can be placed removably inside the chamber (A1), so as to join the outlet passage (U1) to the first additional slot (13) in such a way, as to guide the coins (M1) going out from the outlet passage (U1) toward the first additional slot (13), in order to dispense the coins (M1) from the second lateral wall (L1). Further, the first coin dispenser (E1) can be configured in such a way, as to dispense coins (M1), contained therein, and to dispense the coins (M2), coming from the second dispenser (M2), from the second lateral wall (L1) (as described previously with reference to FIG. 4*c*).

For this purpose, the first dispenser (E1) includes a second additional coin outlet slot (32), made on the second lateral wall (L1), and coin guiding means (3), which can be removably placed inside the chamber (A1), in order to join the additional inner channel (2) to the second additional outlet slot (32), so as to guide and convey the coins (M2) coming from the second dispenser (E2) to the second outlet slot (32), to dispense them from the second lateral wall (L1).

It is doubtless how the above arrangement of coin dispensers allows, in an extremely advantageous way, placement of at least two configurable dispensers, situated one beside another, in one recess made on the face of an automatic machine for coin dispensing (payment or money change), so as to obtain the dispensing of at least two different values of coins from the same dispensing point, or from two dispensing points, situated close to each other, thus making it considerably easier for the user to withdraw the coins.

The advantages and the problems resolved by the configurable coin dispenser proposed by the present invention are evident from the above description.

Actually, it allows to change the point of coin dispensing in the automatic machine, in which it is placed, without any removal and re-placing according to a different orientation.

Moreover, the invention proposes a new arrangement of configurable coin dispensers inside the same recess made in an automatic machine for dispensing and distributing coins, which allows to locate the dispensing of coins of two different values in the same dispensing point, or in two dispensing points, situated close to each other, according to different configurations assumed by the configurable dispensers.

This is a big advantage for the user, who does not have to collect and to withdraw coins dispensed by dispensing points, which are very distant one from another, as it occurred with prior art dispensers situated in different recesses.

The extreme versatility of the configurable coin dispenser, as well as the innovative arrangement of the configurable coin dispensers, connected to each other in the above described way, simplify considerably the design of the automatic machines, inside which the configurable dispensers are to be installed, as well as the logistics arrangement of the dispensers inside the above machines.

It is understood that the proposed invention has been described, with reference to the enclosed figures, as a mere, not limiting example. Therefore, it is obvious that any changes or variants suggested by its use and practice can be applied thereto and remain within the protective scope defined by the following claims.

What is claimed is:

1. A configurable coin dispenser comprising:

a box structure, a storage container situated inside the box structure for storing first coins;

a chamber defined in said box structure, the chamber having a dispensing opening located at a front wall of the box structure:

a first coin outlet passage provided in the chamber for dispensing the first coins therefrom;

a first additional coin outlet slot located on a first lateral wall of said box structure, the first additional coin outlet slot facing said chamber;

coin conveying means removably locatable inside said chamber for connecting said first coin outlet passage with said first additional coin outlet slot for guiding the first coins from said first coin outlet passage to said first additional coin outlet slot, thereby dispensing the first coins from said first lateral wall, wherein said coin conveying means include a first elongated element, which has at a first end thereof, a first coin inlet opening, and, at a second end thereof, a first coin outlet opening, the first elongated element forming thereinside a first coin guiding channel extending from said first coin inlet opening to said first coin outlet opening, said first elongated element being removably locatable inside the chamber, said first elongated element joining the first outlet passage to the first additional coin outlet slot made in said first lateral wall of said box structure.

2. The coin dispenser of claim 1 further comprising a second coin dispenser, a second coin inlet slot provided on a second lateral wall of said box structure, a second coin guiding channel extending from the coin inlet slot to said chamber, the second coin guiding channel receiving second coins of a different value from the first coins from the second coin dispenser, and conveying the second coins to said chamber, so as to dispense the second coins from the dispensing opening located on the front wall of the box structure.

3. The coin dispenser of claim 2 further comprising a second coin outlet slot, made on the first lateral wall of the box structure and facing the chamber, a second coin inlet slot removably locatable inside the chamber, so as to join said second coin guiding channel to said second coin outlet slot, to guide the second coins coming from said second dispenser to said second coin outlet slot, thereby dispensing said second coins from the first lateral wall of said box structure.

4. The coin dispenser of claim 1 further comprising a first closing door removably locatable in a position corresponding to said first additional coin outlet slot, when said coin conveying means are not located in said chamber.

5. The coin dispenser of claim 3 further comprising a closing door removably locatable in a position corresponding to said second coin outlet slot.

6. The coin dispenser of claim 3 further comprising a second elongated element (23), which has, at a first end, a first coin inlet opening (24), and, at a second end, a second coin outlet opening (25), the second elongated element forming thereinside a coin guiding channel extending from said first coin inlet opening to said second coin outlet opening, said second elongated element being removably locatable inside the chamber, such that the first coin inlet opening is joined to the second coin guiding channel for receiving the second coins coming from the second coin dispenser, and said second coin outlet opening is joined to the outlet slot made in said first lateral wall of said box structure for dispensing said second coins therefrom.

7. The coin dispenser of claim 1 further comprising sensor means located at said first coin outlet passage and connected to electronic control means, said sensor means detecting the passage of first coins through said first outlet passage and counting the first coins passing therethrough, for defining a total sum of the first coins dispensed.

8. The coin dispenser of claim 7 further comprising a support element locatable inside the box structure for supporting said sensor means and said electronic control means, the support element being removable through a window made on said first lateral wall, such that the sensor means are locatable in a position corresponding to said first coin outlet passage.

9. The coin dispenser of claim 8 wherein said sensor means include emitter diodes for emitting light radiation, and receiver diodes for receiving light radiation, which are locatable beside a first edge of the first coin outlet passage, and reflecting means, which are locatable beside a second edge of the first coin outlet passage, opposite to the first edge, so as to reflect light radiation emitted by the emitter diodes, to the receiver diodes.

10. The coin dispenser of claim 9, wherein said emitter diodes, said receiver diodes, and said reflecting means, are positionable in opposite edges of a projecting section, made on said support element, which define a coin passage slot, which is locatable beside and joinable to said first coin outlet passage, when the support element is located in the box structure.

11. A configurable coin dispenser comprising:

a box structure;

a storage container situated inside said box structure for storing first coins of a first value;

a chamber defined in said box structure and having a dispensing opening at a front wall of the box structure;

a first coin outlet passage leading to the chamber for dispensing the first coins therefrom;

said configurable coin dispenser having a first coin inlet slot, situated on a first lateral wall of said box structure, and an inner coin guiding channel, which extends from the first coin inlet slot to said chamber, the inner coin guiding channel receiving second coins of a second value coming through said first coin inlet slot, the inner coin guiding channel guiding the second coins to said chamber, such that the second coins are dispensed through the dispensing opening at the front wall of the box structure, wherein said box structure has a second lateral wall, opposite the first lateral wall, and further comprising a first additional slot, made on the second lateral wall and facing said chamber, coin conveying means removably locatable inside said chamber, for joining said first coin outlet passage to said first additional slot for dispensing the first coins through the second lateral wall.

12. The coin dispenser of claim 11 further comprising a second coin outlet slot located on the second lateral wall of the box structure and facing said chamber, and a coin guiding channel removably locatable inside the chamber for joining the inner coin guiding channel to said second coin outlet slot, so as to convey the second coins from said first coin inlet slot to said second coin outlet slot, for dispensing the second coins through the second lateral wall of said box structure.

13. The coin dispenser of claim 11 further comprising a first closing door removably locatable in a position corresponding to said first additional slot, when said coin conveying means are not located in said chamber.

14. The coin dispenser of claim 11 wherein said coin conveying means include a first elongated element, which has, at a first end, a first coin inlet opening, and, a second end, a first coin outlet opening, the first elongated element forming thereinside a first coin guiding channel extending from said first coin inlet opening to said first coin outlet opening, said first elongated element being removably locatable inside the chamber, such that the first coin outlet passage is joined to the first additional slot made in said second lateral wall of said box structure for dispensing first coins therefrom.

15. The coin dispenser of claim 12 further comprising a closing door removably locatable in a position corresponding to said second coin outlet slot.

16. The coin dispenser of claim 15 further comprising a second elongated element, which has, at a first end, a first coin inlet opening, and, at a second end, a second coin outlet opening, the second elongated element forming thereinside a coin guiding channel extending from said first coin inlet opening to said second coin outlet opening, said second elongated element being removably locatable inside the chamber, such that the first coin inlet slot is joined to the coin guiding channel for the second coins coming from the first coin inlet slot, such that said first coin inlet slot is joined to the second coin outlet slot made in said second lateral wall of said box structure for dispensing second coins therefrom.

17. The coin dispenser of claim 11 further comprising sensor means located at said first coin outlet passage and connected to electronic control means, said sensor means detecting the passage of first coins through said first outlet passage and counting the first coins passing therethrough, for defining a total sum of the first coins dispensed therethrough.

18. The coin dispenser of claim 17 further comprising a support element locatable inside the box structure for supporting said sensor means and said electronic control means, the support element being removable through a window made on said second lateral wall, such that the sensor means are locatable in a position corresponding to said first coin outlet passage.

19. The coin dispenser of claim 18 wherein said sensor means include emitter diodes for emitting light radiation, and receiver diodes for receiving light radiation, which are locatable beside a first edge of the first coin outlet passage, and reflecting means, which are locatable beside a second edge of the first coin outlet passage, opposite to the first edge, so as to reflect light radiation emitted by the emitter diodes, to the receiver diodes.

20. The coin dispenser of claim 19, wherein said emitter diodes, said receiver diodes, and said reflecting means, are positioned in opposite edges of a projecting section, made on said support element, which define a coin passage slot, which is locatable beside and joinable to said first coin outlet passage, when the support element is located in the box structure.

21. An arrangement of configurable coin dispensers comprising:

a first configurable dispenser for first coins of a first value, having an outlet passage for said first coins which leads to a chamber having a dispensing opening on a front wall of the first configurable dispenser, for dispensing first coins therethrough, the first configurable coin dispenser having a coin inlet slot provided on a first lateral wall, and an additional coin guiding channel which extends from the coin inlet slot to the chamber;

a second configurable dispenser for second coins of a second value, having a second coin outlet passage for said second coins, said second dispenser having a first additional slot, made on a second dispenser lateral wall, coin conveying means removably locatable inside the chamber, so as to connect the second coin outlet passage with the first additional slot, in order to dispense the second coins from the second dispenser lateral wall, said second dispenser being connected to the first dispenser by the second dispenser lateral wall, which is located beside the first lateral wall of the first dispenser, the first additional slot, facing and joining to the first coin inlet slot and the additional coin guiding channel of the first dispenser, so that the second coins of the second dispenser are conveyed to the chamber of said first dispenser and dispensed from the dispensing opening located on the front wall of the first dispenser.

22. The arrangement of configurable coin dispensers of claim 21 wherein said first dispenser further comprises coin outlet slot made on a second lateral wall thereof, a coin conveying channel removably locatable inside the chamber, so as to connect the outlet passage for the first coins to the coin outlet slot for guiding the first coins from the outlet passage toward the coin outlet slot, to dispense the first coins from the second lateral wall.

23. The arrangement of configurable coin dispensers of claim 21, wherein said first coin dispenser further comprises a second coin outlet slot, made on the second lateral wall, a second coin guiding channel removably locatable inside the chamber, for joining the coin inlet slot to said second coin outlet slot, so as to guide and convey the second coins coming from said second dispenser to the second coin outlet slot, to dispense the second coins from the second lateral wall of the first dispenser.

* * * * *